US009035980B2

(12) United States Patent
Yang et al.

(10) Patent No.: US 9,035,980 B2
(45) Date of Patent: May 19, 2015

(54) METHOD OF USING A PIXEL TO DISPLAY AN IMAGE

(75) Inventors: Hsueh-Yen Yang, Hsin-Chu (TW); Yun-Hsiang Lee, Hsin-Chu (TW); Tze-Chien Tsai, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 434 days.

(21) Appl. No.: 13/485,842

(22) Filed: May 31, 2012

(65) Prior Publication Data

US 2013/0070006 A1 Mar. 21, 2013

(30) Foreign Application Priority Data

Sep. 21, 2011 (TW) ..... 100133914 A

(51) Int. Cl.
*G09G 3/32* (2006.01)

(52) U.S. Cl.
CPC ..... *G09G 3/3225* (2013.01); *G09G 2300/0452* (2013.01)

(58) Field of Classification Search
CPC ..... G09G 3/30–3/3258; G09G 5/02–5/026; G09G 2300/0439–2300/0452
USPC ..... 345/690–697, 82, 83
See application file for complete search history.

(56) References Cited

U.S. PATENT DOCUMENTS

2007/0222800 A1 9/2007 Fish et al.
2008/0100553 A1 5/2008 Shen
2008/0224968 A1 * 9/2008 Kashiwabara ..... 345/83
2012/0256938 A1 * 10/2012 So ..... 345/589

FOREIGN PATENT DOCUMENTS

TW 200605002 A 2/2006

OTHER PUBLICATIONS

So et al., SID 10 Digest, pp. 622-625, 43.3: Power Efficient AMOLED Display with Novel Four Sub-Pixel Architecture and Driving Scheme, 2010.

* cited by examiner

*Primary Examiner* — Nathan Danielsen
(74) *Attorney, Agent, or Firm* — Winston Hsu; Scott Margo

(57) ABSTRACT

A first sub-pixel, a second sub-pixel and a third sub-pixel of a pixel are utilized to display a first white image, then a first brightness of the first sub-pixel and a first brightness of the second sub-pixel are measured. The first sub-pixel, the second sub-pixel and a fourth sub-pixel of the pixel are utilized to display a second white image, then a second brightness of the first sub-pixel and a second brightness of the second sub-pixel are measured. How image data should be displayed is determined according to whether the first brightness of the first sub-pixel is greater than the second brightness of the first sub-pixel, whether the first brightness of the second sub-pixel is greater than the second brightness of the second sub-pixel, and whether a chromaticity coordinate of the image data is within a chromaticity range capable of being displayed by the first, second and third sub-pixels.

18 Claims, 3 Drawing Sheets

METHOD OF USING A PIXEL TO DISPLAY AN IMAGE

BACKGROUND OF THE INVENTION

1. Field of the Invention

The present invention relates to a method of using pixels to display an image, and more particularly, to a method of using pixels with various brightness to display an image.

2. Description of the Prior Art

Due to the low luminous efficiency of materials for generating blue light in existing AMOLED display panels, the thin film transistor (TFT) driver in the driving circuit has to supply a large driving current to enable the AMOLED display panel providing sufficient blue light. However, this may reduce the lifetime of the materials for generating blue light and increase the power consumption of the AMOLED display, consequently damaging the AMOLED display.

SUMMARY OF THE INVENTION

In accordance with one embodiment of the present invention, a method of using a pixel to display an image is disclosed. The pixel comprises a first sub-pixel, a second sub-pixel, a third sub-pixel and a fourth sub-pixel. The third sub-pixel and the fourth sub-pixel are used to display a substantially same color. The method includes providing a first brightness of the first sub-pixel and a first brightness of the second sub-pixel in a first display mode; providing a second brightness of the first sub-pixel and a second brightness of the second sub-pixel in a second display mode; inputting an image signal having a chromaticity coordinate; generating a first comparison relationship according to the first brightness of the first sub-pixel and the second brightness of the first sub-pixel; generating a second comparison relationship according to the first brightness of the second sub-pixel and the second brightness of the second sub-pixel; if the chromaticity coordinate of the image signal is within a chromaticity range capable of being displayed by the first sub-pixel, the second sub-pixel and the third sub-pixel, processing the image signal according to the first comparison relationship, the second comparison relationship and the chromaticity coordinate of the image signal; and displaying the processed image signal in the first display mode. The first display mode is performed by using the first sub-pixel, the second sub-pixel, and the third sub-pixel to display an image. The second display mode is performed by using the first sub-pixel, the second sub-pixel, and the fourth sub-pixel to display the image.

In accordance with another embodiment of the present invention, a method of using a pixel to display an image is disclosed. The pixel comprises a first sub-pixel, a second sub-pixel, a third sub-pixel and a fourth sub-pixel. The third sub-pixel and the fourth sub-pixel are used to display a substantially same color. The method includes providing a first brightness of the first sub-pixel and a first brightness of the second sub-pixel in a first display mode; providing a second brightness of the first sub-pixel and a second brightness of the second sub-pixel in a second display mode; inputting an image signal having a chromaticity coordinate; generating a first comparison relationship according to the first brightness of the first sub-pixel and the second brightness of the first sub-pixel; generating a second comparison relationship according to the first brightness of the second sub-pixel and the second brightness of the second sub-pixel; if the chromaticity coordinate of the image signal is outside a chromaticity range capable of being displayed by the first sub-pixel, the second sub-pixel and the third sub-pixel, processing the image signal according to the first comparison relationship, the second comparison relationship and the chromaticity coordinate of the image signal; and displaying the processed image signal in the second display mode. The first display mode is performed by using the first sub-pixel, the second sub-pixel, and the third sub-pixel to display an image. The second display mode is performed by using the first sub-pixel, the second sub-pixel, and the fourth sub-pixel to display the image.

These and other objectives of the present invention will no doubt become obvious to those of ordinary skill in the art after reading the following detailed description of the preferred embodiment that is illustrated in the various figures and drawings.

DETAILED DESCRIPTION

FIG. 1A to FIG. 1H are diagrams illustrating various pixel arrangements of a pixel in a display (i.e., an active matrix organic light emitting diode AMOLED) according to an embodiment of the present invention. The AMOLED display has a plurality of pixels arranged as an array (i*j), and each of the pixels has a first sub-pixel (i.e., a red sub-pixel R), a second sub-pixel (i.e., a green sub-pixel G), a third sub-pixel (i.e. a first blue sub-pixel B1), a fourth sub-pixel (i.e. a second blue sub-pixel B2). The pixel arrangements of the above four color sub-pixels are illustrated as shown in FIG. 1A to FIG. 1H, but are not limited as such. In the present embodiment, the red, green, first blue (light blue), and second blue (dark blue) sub-pixels in each pixel of the AMOLED display can be arranged as a 2 by 2 matrix or a 1 by 4 matrix.

Because the luminous efficiency of the material for generating cyan light is at least four times that of the material for generating blue light, in the present embodiment, each pixel is formed by four sub-pixels. And materials for generating red, green, first blue (light blue), and second blue (dark blue) light are used to form red, green, first blue and second blue sub-pixels of the pixel respectively. Further, only one of the first blue and second blue sub-pixels is used with the red and green sub-pixels to display an image of the pixel in each frame. The dark blue sub-pixel has higher color saturation and the light blue sub-pixel has higher luminous efficiency. If the chromaticity coordinate of an image signal is within a chromaticity range capable of being displayed by the first sub-pixel, the second sub-pixel and the third sub-pixel and within a chromaticity range capable of being displayed by the first sub-pixel, the second sub-pixel and the fourth sub-pixel, the image signal is displayed by using the first sub-pixel, the second sub-pixel, and the third sub-pixel. Accordingly, the luminous efficiency of the AMOLED is improved, and the power consumption of the entire AMOLED display is reduced.

Figure 1A:
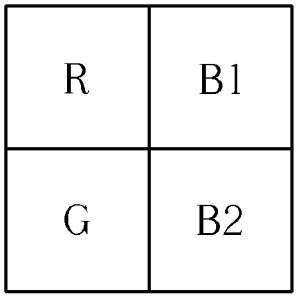
FIG. 1A to FIG. 1H are diagrams illustrating various pixel arrangements of a pixel in a display according to an embodiment of the present invention.
Figure 1B:
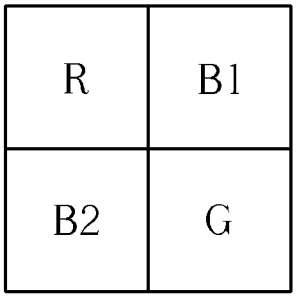
Figure 1C:
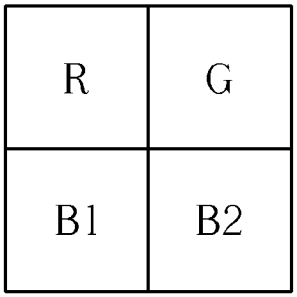
Figure 1D:
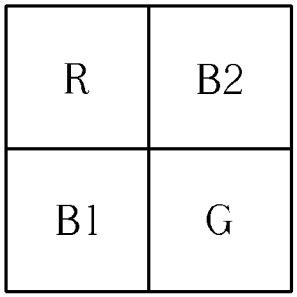
Figure 1E:
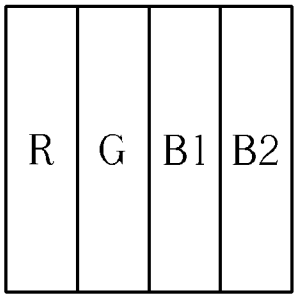
Figure 1F:
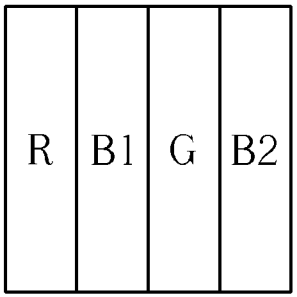
Figure 1G:
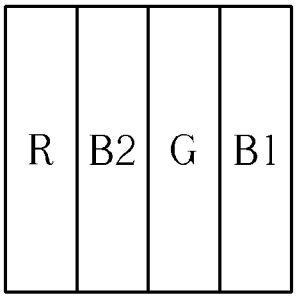
Figure 1H:
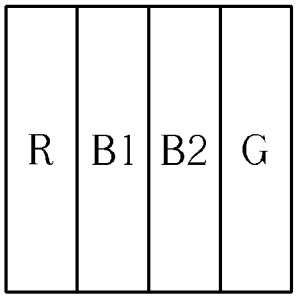
Figure 2:
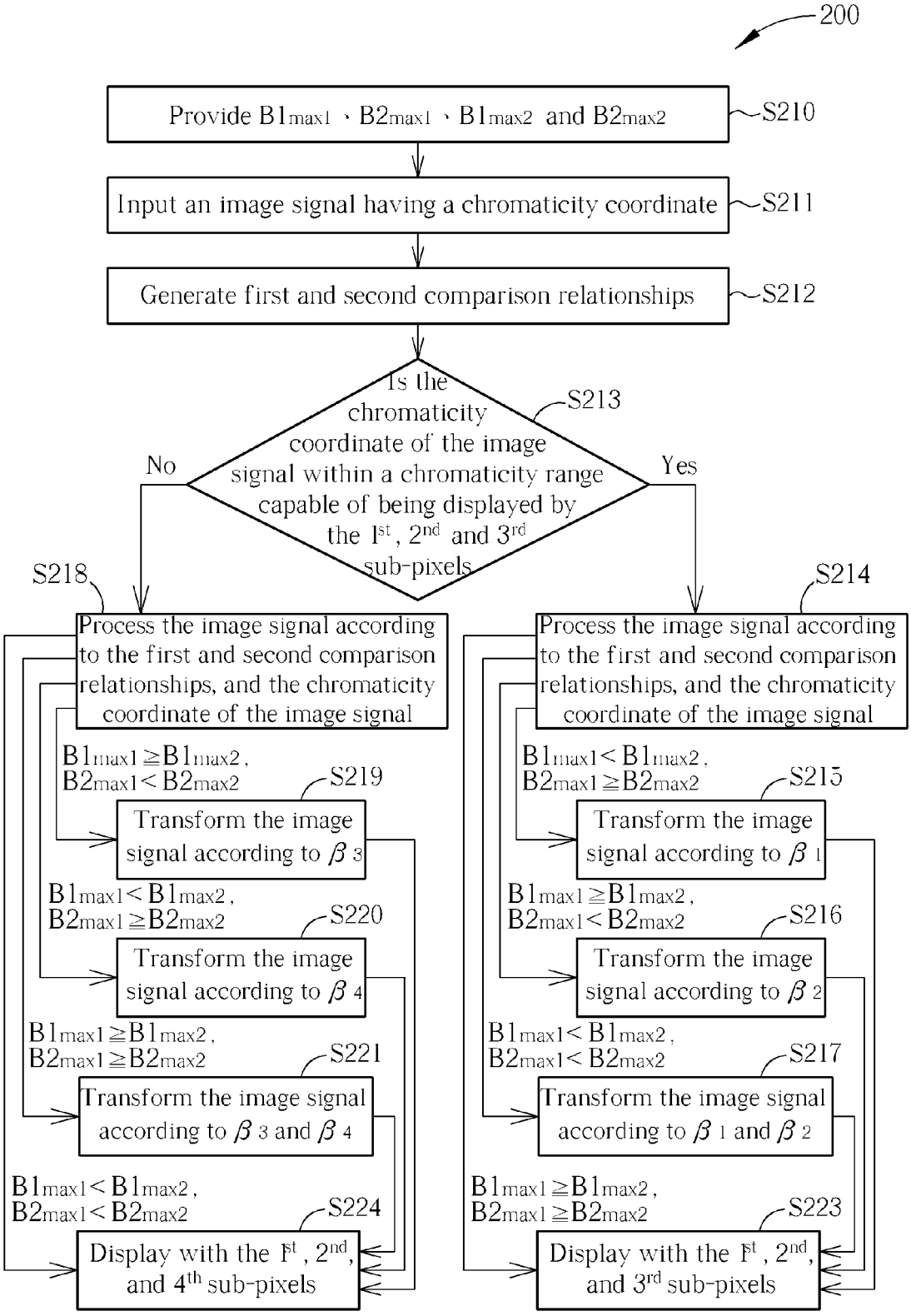
FIG. 2 is a flowchart illustrating how to display an image with a pixel according to an embodiment of the present invention.

Please refer to FIG. 2 which shows a flowchart of a method of using a pixel to display an image. The method 200 comprises the following steps:

Step S210: Provide a first brightness $B1_{max1}$ of the first sub-pixel and a first brightness $B2_{max1}$ of the second sub-pixel in a first display mode and providing a second brightness $B1_{max2}$ of the first sub-pixel and a second brightness $B2_{max2}$ of the second sub-pixel in a second display mode;

Step S211: Input an image signal having a chromaticity coordinate;

Step S212: Generate a first comparison relationship according to the first brightness $B1_{max1}$ of the first sub-pixel and the second brightness $B1_{max2}$ of the first sub-pixel and generate a second comparison relationship according to the first brightness $B2_{max1}$ of the second sub-pixel and the second brightness $B2_{max2}$ of the second sub-pixel;

Step S213: Determine whether the chromaticity coordinate of the image signal is within a chromaticity range capable of being displayed by the first sub-pixel, the second sub-pixel and the third sub-pixel, if yes, perform Step S214, if not, perform Step S218;

Step S214: Process the image signal according to the first comparison relationship, the second comparison relationship and the chromaticity coordinate of the image signal, if the first brightness $B1_{max1}$ of the first sub-pixel is greater than/equal to the second brightness $B1_{max2}$ of the first sub-pixel and the first brightness $B2_{max1}$ of the second sub-pixel is greater than/equal to the second brightness $B2_{max2}$ of the second sub-pixel, transmit the image signal without transforming the image signal and perform step S223, if the first brightness $B1_{max1}$ of the first sub-pixel is smaller than the second brightness $B1_{max2}$ of the first sub-pixel and the first brightness $B2_{max1}$ of the second sub-pixel is greater than/equal to the second brightness $B2_{max2}$ of the second sub-pixel, perform step S215, if the first brightness $B1_{max1}$ of the first sub-pixel is greater than/equal to the second brightness $B1_{max2}$ of the first sub-pixel and the first brightness $B2_{max1}$ of the second sub-pixel is smaller than the second brightness $B2_{max2}$ of the second sub-pixel, perform step S216, if the first brightness $B1_{max1}$ of the first sub-pixel is smaller than the second brightness $B1_{max2}$ of the first sub-pixel and the first brightness $B2_{max1}$ of the second sub-pixel is smaller than the second brightness $B2_{max2}$ of the second sub-pixel, perform step S217;

Step S215: Transform the image signal according to a first brightness ratio $\beta_1$, and perform step S223, in which the first brightness ratio $\beta_1$ is the ratio of the first brightness $B1_{max1}$ of the first sub-pixel and the second brightness $B1_{max2}$ of the first sub-pixel;

Step S216: Transform the image signal according to a second brightness ratio $\beta_2$, and perform step S223, in which the second brightness ratio $\beta_2$ is the ratio of the first brightness $B2_{max1}$ of the second sub-pixel and the second brightness $B2_{max2}$ of the second sub-pixel;

Step S217: Transform the image signal according to a first brightness ratio $\beta_1$ and a second brightness ratio $\beta_2$, and perform step S223, in which the first brightness ratio $\beta_1$ is the ratio of the first brightness $B1_{max1}$ of the first sub-pixel and the second brightness $B1_{max2}$ of the first sub-pixel and the second brightness ratio $\beta_2$ is the ratio of the first brightness $B2_{max1}$ of the second sub-pixel and the second brightness $B2_{max2}$ of the second sub-pixel;

Step S218: Process the image signal according to the first comparison relationship, the second comparison relationship and the chromaticity coordinate of the image signal, if the first brightness $B1_{max1}$ of the first sub-pixel is smaller than the second brightness $B1_{max2}$ of the first sub-pixel and the first brightness $B2_{max1}$ of the second sub-pixel is smaller than the second brightness $B2_{max2}$ of the second sub-pixel, transmit the image signal without transforming the image signal, and perform step S224, if the first brightness $B1_{max1}$ of the first sub-pixel is greater than/equal to the second brightness $B1_{max2}$ of the first sub-pixel and the first brightness $B2_{max1}$ of the second sub-pixel is smaller than the second brightness $B2_{max2}$ of the second sub-pixel, perform step S219, if the first brightness $B1_{max1}$ of the first sub-pixel is smaller than the second brightness $B1_{max2}$ of the first sub-pixel and the first brightness $B2_{max1}$ of the second sub-pixel is greater than/equal to the second brightness $B2_{max2}$ of the second sub-pixel, perform step S220, if the first brightness $B1_{max1}$ of the first sub-pixel is greater than/equal to the second brightness $B1_{max2}$ of the first sub-pixel and the first brightness $B2_{max1}$ of the second sub-pixel is greater than/equal to the second brightness $B2_{max2}$ of the second sub-pixel, perform step S221;

Step S219: Transform the image signal according to a third brightness ratio $\beta_3$, and perform step S224, in which the third brightness ratio $\beta_3$ is the ratio of the second brightness $B1_{max2}$ of the first sub-pixel and the first brightness $B1_{max1}$ of the first sub-pixel;

Step S220: Transform the image signal according to a fourth brightness ratio $\beta_4$, and perform step S224, in which the fourth brightness ratio $\beta_4$ is the ratio of the second brightness $B2_{max2}$ of the second sub-pixel and the first brightness $B2_{max1}$ of the second sub-pixel;

Step S221: Transform the image signal according to a third brightness ratio $\beta_3$ and a fourth brightness ratio $\beta_4$, and perform step S224, in which the third brightness ratio $\beta_3$ is the ratio of the second brightness $B1_{max2}$ of the first sub-pixel and the first brightness $B1_{max1}$ of the first sub-pixel and the fourth brightness ratio $\beta_4$ is the ratio of the second brightness $B2_{max2}$ of the second sub-pixel and the first brightness $B2_{max1}$ of the second sub-pixel;

Step S223: Display an image with the first sub-pixel, the second sub-pixel, and the third sub-pixel according to the image signal or the transformed image signal.

Step S224: Display an image with the first sub-pixel, the second sub-pixel, and the fourth sub-pixel according to the image signal or the transformed image signal.

In step S210, the first sub-pixel (i.e., a red sub-pixel R), the second sub-pixel (i.e., a green sub-pixel G) and the third sub-pixel (i.e., a first blue sub-pixel B1) are used to generate a first white image, i.e. displaying the white image in a first display mode. When the first white image is generated, measure the first brightness $B1_{max1}$ of the red sub-pixel and the first brightness $B2_{max1}$ of the green sub-pixel. Then the first sub-pixel (i.e., a red sub-pixel R), the second sub-pixel (i.e., a green sub-pixel G) and the fourth sub-pixel (i.e., a second blue sub-pixel B2) are used to generate a second white image, i.e. displaying the white image in the second display mode. The second white image has the same chromaticity coordinate as the first white image. When the second white image is generated, measure the second brightness $B1_{max2}$ of the red sub-pixel and the second brightness $B2_{max2}$ of the green sub-pixel. In step S212, the first brightness $B1_{max1}$ of the red sub-pixel is compared with the second brightness $B1_{max2}$ of the red sub-pixel to generate the first comparison relationship. The first brightness $B2_{max1}$ of the green sub-pixel is compared with the second brightness $B2_{max2}$ of the green sub-pixel to generate the second comparison relationship. Step S213 is used to determine if step S214 or step S218 should be performed according to whether the chromaticity coordinate of the image signal is within a chromaticity range capable of being displayed by the first sub-pixel, the second sub-pixel and the third sub-pixel or not.

In step S214, the image signal is processed according to the first comparison relationship, the second comparison relationship and the chromaticity coordinate of the image signal. The processing scheme of the image signal may be simply transmitting the image signal or transforming the image signal. If $B1_{max1} \geq B1_{max2}$, $B2_{max1} \geq B2_{max2}$, and the chromaticity coordinate of the image signal is within a chromaticity range capable of being displayed by the red, green and first blue sub-pixels, the image signal is transmitted without transforming the image signal and then the step S223 is performed to display an image with the red, green and first blue sub-pixels according to the image signal. For example, when using the red sub-pixel R, the green sub-pixel G and the first blue sub-pixel B1 to generate the first white image, the measured $B1_{max1}$ is 1398 lumen, $B1_{max2}$ is 3055 lumen, and the chromaticity coordinate of the first white image is (0.28, 0.33) in CIE 1931 color space. When using the red sub-pixel R, the green sub-pixel G and the second blue sub-pixel B2 to generate the second white image having the same chromaticity coordinate as the first white image (0.28, 0.33) in CIE 1931 color space, the measured $B2_{max1}$ is 1191 lumen and $B2_{max2}$ is 1989 lumen. If the chromaticity coordinate of the image signal (i.e. R=255、G=200、B=220) is within a chromaticity range capable of being displayed by the red, green and first blue sub-pixels, the image is displayed by the red, green and first blue sub-pixels according to the image signal (R=255、G=200、B=220) without transforming the image signal because $B1_{max1} \geq B1_{max2}$ and $B2_{max1} \geq B2_{max2}$.

In step S214, if $B1_{max1} < B1_{max2}$, $B2_{max1} \geq B2_{max2}$ and the chromaticity coordinate of the image signal is within a chromaticity range capable of being displayed by the red, green and first blue sub-pixels, the step S215 is performed to transform the image signal according to the first brightness ratio $\beta_1$, and then the step S223 is performed to display an image with the red, green and first blue sub-pixels according to the transformed image signal. If $B1_{max1} \geq B1_{max2}$ and $B2_{max1} < B2_{max2}$ and the chromaticity coordinate of the image signal is within a chromaticity range capable of being displayed by the red, green and first blue sub-pixels, the step S216 is performed to transform the image signal according to the second brightness ratio $\beta_2$, and then the step S223 is performed to display an image with the red, green and first blue sub-pixels according to the transformed image signal. If $B1_{max1} < B1_{max2}$, $B2_{max1} < B2_{max2}$ and the chromaticity coordinate of the image signal is within a chromaticity range capable of being displayed by the red, green and first blue sub-pixels, the step S217 is performed to transform the image signal according to the first brightness ratio $\beta_1$ and the second brightness ratio $\beta_2$, and then the step S223 is performed to display an image with the red, green and first blue sub-pixels according to the transformed image signal.

In step S215, if $B1_{max1} < B1_{max2}$, $B2_{max1} \geq B2_{max2}$ and the chromaticity coordinate of the image signal is within a chromaticity range capable of being displayed by the red, green and first blue sub-pixels, a red brightness ratio $\beta_1$ is generated according to $B1_{max1}$ and $B1_{max2}$, the image signal is transformed according to $\beta_1$, and an image is displayed according to the transformed image signal by using the red, green, and first blue sub-pixels. $\beta_1$ is generated according to the following equation 1:

$$\beta_1 = \frac{x12}{x11} = \left(\frac{B1_{max1}}{B1_{max2}}\right)^{\frac{1}{\gamma 1}}; \quad \text{(equation 1)}$$

Figure 3:
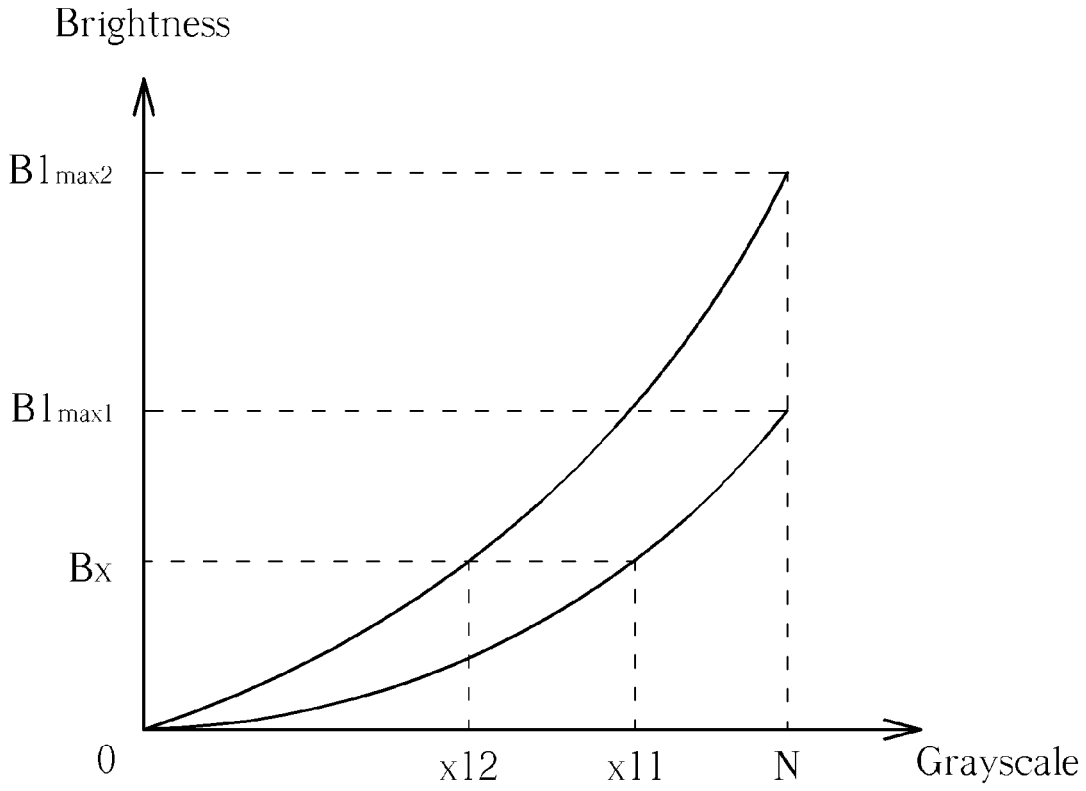
FIG. 3 is a diagram illustrating how to generate a brightness ratio according to an embodiment of the present invention.

In equation 1, x11 is a grayscale of the red sub-pixel when the red, green and first blue sub-pixels are used to generate a first predetermined brightness Bx. x12 is a grayscale of the red sub-pixel when the red, green and the second blue sub-pixels are used to generate the first predetermined brightness Bx. $B1_{max1}$ is the first brightness of the red sub-pixel, $B1_{max2}$ is the second brightness of the red sub-pixel and $\gamma 1$ is a gamma value of the red sub-pixel (i.e., $\gamma 1$=2.2). Please refer to FIG. 3, which is a diagram illustrating how to generate the red brightness ratio $\beta_1$ according to an embodiment of the present invention. The relationship between $B1_{max1}$, $B1_{max2}$ and $\beta_1$ is derived as follow:

$$Bx = \left(\frac{x12}{n}\right)^{\gamma 1} \times B1_{max2} = \left(\frac{x11}{N}\right)^{\gamma 1} \times B1_{max1} \quad \text{(equation 2)}$$

$$\Rightarrow \beta 1 = \frac{x12}{x11} = \left(\frac{B1_{max1}}{B1_{max2}}\right)^{\frac{1}{\gamma 1}};$$

In equation 2, N is the maximum grayscale of the image signal (i.e., N is 255). For example, when using the red sub-pixel R, the green sub-pixel G and the first blue sub-pixel B1 to generate the first white image having a chromaticity coordinate (0.28, 0.33) in CIE 1931 color space, the measured first brightness of the red sub-pixel $B1_{max1}$ is 1191 lumen, and the measured first brightness of the green sub-pixel $B2_{max1}$ is 3055 lumen. When using the red sub-pixel R, the green sub-pixel G and the second blue sub-pixel B2 to generate the second white image having the same chromaticity coordinate as the first white image, the measured second brightness of the red sub-pixel $B1_{max2}$ is 1398 lumen, and the measured second brightness of the green sub-pixel $B2_{max2}$ is 1989 lumen. If the chromaticity coordinate of the image signal (i.e. R=255、G=200、B=220) is within a chromaticity range capable of being displayed by the red sub-pixel, the green sub-pixel and the first blue sub-pixel, the red brightness ratio $\beta_1$ is generated according to $B1_{max1}$ and $B1_{max2}$ because $B1_{max1} < B1_{max2}$ and $B2_{max1} \geq B2_{max2}$, the red signal of the image signal is transformed according to the red brightness ratio $\beta_1$, and the image is displayed according to the transformed image signal (R', G', B') by using the red sub-pixel, the green sub-pixel, and the first blue sub-pixel. In this example, $\beta_1$ is:

$$\beta_1 = \frac{x12}{x11} = \left(\frac{B1_{max1}}{B1_{max2}}\right)^{\frac{1}{\gamma 1}} = \left(\frac{1191}{1398}\right)^{\frac{1}{2.2}} = 0.929$$

The transformed image signal (R', G', B') is calculated as follows:

$$R' = 255 \times \beta_1 = 255 \times 0.929 = 236$$

$$G' = G = 200$$

$$B' = B = 220$$

In step S216, if $B1_{max1} \geq B1_{max2}$, $B2_{max1} < B2_{max2}$ and the chromaticity coordinate of the image signal is within a chromaticity range capable of being displayed by the red, green and first blue sub-pixels, a green brightness ratio $\beta_2$ is generated according to $B2_{max1}$ and $B2_{max2}$, the image signal is transformed according to $\beta_2$, and then the image is displayed according to the transformed image signal by using the red, green, and first blue sub-pixels. $\beta_2$ is generated according to the following equation 3:

$$\beta_2 = \frac{x22}{x21} = \left(\frac{B2_{max1}}{B2_{max2}}\right)^{\frac{1}{\gamma 2}}; \quad \text{(equation 3)}$$

In equation 3, x21 is a grayscale of the green sub-pixel when the red, green and first blue sub-pixels are used to generate a second predetermined brightness Bx. x22 is a grayscale of the green sub-pixel when the red, green and second blue sub-pixels are used to generate the second predetermined brightness Bx. $B2_{max1}$ is the first brightness of the green sub-pixel, $B2_{max2}$ is the second brightness of the green sub-pixel and γ2 is a gamma value of the green sub-pixel (i.e., γ2=2.2). The derivation of equation 3 is similar to equation 1. In the present embodiment, when using the red sub-pixel R, the green sub-pixel G and the first blue sub-pixel B1 to generate the first white image having a chromaticity coordinate (0.28, 0.33) in CIE 1931 color space, the measured first brightness of the red sub-pixel $B1_{max1}$ is 1398 lumen and the measured first brightness of the green sub-pixel $B2_{max1}$ is 1989 lumen. When using the red sub-pixel R, the green sub-pixel G and the second blue sub-pixel B2 to generate the second white image having the same chromaticity coordinate as the first white image, the measured second brightness of the red sub-pixel $B1_{max2}$ is 1191 lumen, and the measured second brightness of the green sub-pixel $B2_{max2}$ is 3055 lumen. If the chromaticity coordinate of the image signal (i.e. R=255、G=200、B=220) is within a chromaticity range capable of being displayed by the red sub-pixel, the green sub-pixel and the first blue sub-pixel, the green brightness ratio $\beta_2$ is generated according to $B2_{max1}$ and $B2_{max2}$ because $B1_{max1} \geq B1_{max2}$ and $B2_{max1} < B2_{max2}$, the green signal of the image signal is transformed according to the green brightness ratio $\beta_2$, and the image is displayed according to the transformed image signal (R', G', B') by using the red sub-pixel, the green sub-pixel, and the first blue sub-pixel. In this example, $\beta_2$ is:

$$\beta_2 = \frac{x22}{x21} = \left(\frac{B2_{max1}}{B2_{max2}}\right)^{\frac{1}{\gamma 2}} = \left(\frac{1989}{3055}\right)^{\frac{1}{2.2}} = 0.822$$

The transformed image signal (R', G', B') is calculated as follows:

$$R' = R = 255$$

$$G' = 200 \times \beta_2 = 200 \times 0.822 = 164$$

$$B' = B = 220$$

In step S217, if $B1_{max1} < B1_{max2}$, $B2_{max1} < B2_{max2}$ and the chromaticity coordinate of the image signal is within a chromaticity range capable of being displayed by the red, green and first blue sub-pixels, a red brightness ratio $\beta_1$ is generated according to the $B1_{max1}$ and $B1_{max2}$, a green brightness ratio $\beta_2$ is generated according to the $B2_{max1}$ and $B2_{max2}$, the image signal is transformed according to $\beta_1$ and $\beta_2$, and then the image is displayed according to the transformed image signal by using the red, green, and first blue sub-pixels. $\beta_1$ and $\beta_2$ are generated according to the following equations respectively:

$$\beta_1 = \frac{x12}{x11} = \left(\frac{B1_{max1}}{B1_{max2}}\right)^{\frac{1}{\gamma 1}};$$

-continued $$\beta_2 = \frac{x22}{x21} = \left(\frac{B2_{max1}}{B2_{max2}}\right)^{\frac{1}{\gamma 2}};$$

For example, when using the red sub-pixel R, the green sub-pixel G and the first blue sub-pixel B1 to generate the first white image having a chromaticity coordinate (0.28, 0.33) in CIE 1931 color space, the measured first brightness of the red sub-pixel $B1_{max1}$ is 1191 lumen, and the measured first brightness of the green sub-pixel $B2_{max1}$ is 1989 lumen. When using the red sub-pixel R, the green sub-pixel G and the second blue sub-pixel B2 to generate the second white image having the same chromaticity coordinate as the first white image, the measured second brightness of the red sub-pixel $B1_{max2}$ is 1398 lumen and the measured second brightness of the green sub-pixel $B2_{max2}$ is 3055 lumen. If the chromaticity coordinate of the image signal (i.e. R=255、G=200、B=220) is within a chromaticity range capable of being displayed by the red sub-pixel, the green sub-pixel and the first blue sub-pixel, the red brightness ratio $\beta_1$ is generated according to $B1_{max1}$ and $B1_{max2}$, the green brightness ratio $\beta_2$ is generated according to the $B2_{max1}$ and $B2_{max2}$ because $B1_{max1} < B1_{max2}$ and $B2_{max1} < B2_{max2}$, the red signal of the image signal is transformed according to the red brightness ratio $\beta_1$ and the green signal of the image signal is transformed according to the green brightness ratio $\beta_2$. Then the image is displayed according to the transformed image signal (R', G', B') by using the red sub-pixel, the green sub-pixel, and the first blue sub-pixel. In this example, $\beta_1$ is:

$$\beta_1 = \frac{x12}{x11} = \left(\frac{B1_{max1}}{B1_{max2}}\right)^{\frac{1}{\gamma 1}} = \left(\frac{1191}{1398}\right)^{\frac{1}{2.2}} = 0.929$$

In this example, $\beta_2$ is:

$$\beta_2 = \frac{x22}{x21} = \left(\frac{B2_{max1}}{B2_{max2}}\right)^{\frac{1}{\gamma 1}} = \left(\frac{1989}{3055}\right)^{\frac{1}{2.2}} = 0.822$$

The transformed image signal (R', G', B') is calculated as follows:

$$R' = 255 \times \beta_1 = 255 \times 0.929 = 236$$

$$G' = 200 \times \beta_2 = 200 \times 0.822 = 164$$

$$B' = B = 220$$

In step S218, the image signal is processed according to the first comparison relationship, the second comparison relationship and the chromaticity coordinate of the image signal. The processing scheme of the image signal may be simply transmitting the image signal or transforming the image signal. If $B1_{max1} < B1_{max2}$, $B2_{max1} < B2_{max2}$, and the chromaticity coordinate of the image signal is outside a chromaticity range capable of being displayed by the red, green and first blue sub-pixels, the image signal is transmitted without transforming the image signal and the step S224 is performed to display an image with the red, green and second blue sub-pixels according to the image signal. For example, when using the red sub-pixel R, the green sub-pixel G and the first blue sub-pixel B1 to generate the first white image, the measured $B1_{max1}$ is 1191 lumen, $B1_{max2}$ is 1398 lumen, and the chromaticity coordinate of the first white image is (0.28, 0.33) in CIE 1931 color space. When using the red sub-pixel R, the green sub-pixel G and the second blue sub-pixel B2 to generate the second white image having the same chromaticity coordinate as the first white image (0.28, 0.33) in CIE 1931 color space, the measured $B2_{max1}$ is 1989 lumen and $B2_{max2}$ is 3055 lumen. If the chromaticity coordinate of the image signal (i.e. R=255、G=200、B=220) is outside a chromaticity range capable of being displayed by the red, green and first blue sub-pixels, the step S224 is performed to display the image according to the image signal with the red, green and second blue sub-pixels without transforming the image signal because $B1_{max1}<B1_{max2}$ and $B2_{max1}<B2_{max2}$.

In step S218, if $B1_{max1}\geq B1_{max2}$, $B2_{max1}<B2_{max2}$ and the chromaticity coordinate of the image signal is outside a chromaticity range capable of being displayed by the red, green and first blue sub-pixels, the step S219 is performed to transform the image signal according to the third brightness ratio $\beta_3$, and the step S224 is performed to display an image with the red, green and second blue sub-pixels according to the transformed image signal. If $B1_{max1}<B1_{max2}$ and $B2_{max1}\geq B2_{max2}$ and the chromaticity coordinate of the image signal is outside a chromaticity range capable of being displayed by the red, green and first blue sub-pixels, the step S220 is performed to transform the image signal according to the fourth brightness ratio $\beta_4$, and the step S224 is performed to display an image with the red, green and second blue sub-pixels according to the transformed image signal. If $B1_{max1}\geq B1_{max2}$, $B2_{max1}\geq B2_{max2}$ and the chromaticity coordinate of the image signal is outside a chromaticity range capable of being displayed by the red, green and first blue sub-pixels, the step S221 is performed to transform the image signal according to the third brightness ratio $\beta_3$ and the fourth brightness ratio $\beta_4$, and the step S224 is performed to display an image with the red, green and second blue sub-pixels according to the transformed image signal.

In step S219, if $B1_{max1}\geq B1_{max2}$, $B2_{max1}<B2_{max2}$ and the chromaticity coordinate of the image signal is outside a chromaticity range capable of being displayed by the red, green and first blue sub-pixels, a red brightness ratio $\beta_3$ is generated according to $B1_{max1}$ and $B1_{max2}$, the image signal is transformed according to $\beta_3$, and the image is displayed according to the transformed image signal by using the red, green, and second blue sub-pixels. $\beta_3$ is generated according to the following equation 4:

$$\beta_3 = \frac{x11}{x12} = \left(\frac{B1_{max2}}{B1_{max1}}\right)^{\frac{1}{\gamma 1}}; \quad \text{(equation 4)}$$

In equation 4, x11 is a grayscale of the red sub-pixel when the red, green and first blue sub-pixels are used to generate a first predetermined brightness Bx. x12 is a grayscale of the red sub-pixel when the red, green and the second blue sub-pixels are used to generate the first predetermined brightness Bx. $B1_{max1}$ is the first brightness of the red sub-pixel, $B1_{max2}$ is the second brightness of the red sub-pixel and $\gamma 1$ is a gamma value of the red sub-pixel (i.e., $\gamma 1=2.2$). For example, when using the red sub-pixel R, the green sub-pixel G and the first blue sub-pixel B1 to generate the first white image having a chromaticity coordinate (0.28, 0.33) in CIE 1931 color space, the measured first brightness of the red sub-pixel $B1_{max1}$ is 1398 lumen, and the measured first brightness of the green sub-pixel $B2_{max1}$ is 1989 lumen. When using the red sub-pixel R, the green sub-pixel G and the second blue sub-pixel B2 to generate the second white image having the same chromaticity coordinate as the first white image, the measured second brightness of the red sub-pixel $B1_{max2}$ is 1191 lumen, and the measured second brightness of the green sub-pixel $B2_{max2}$ is 3055 lumen. If the chromaticity coordinate of the image signal (i.e. R=5、G=10、B=240) is outside a chromaticity range capable of being displayed by the red sub-pixel, the green sub-pixel and the first blue sub-pixel, the red brightness ratio $\beta_3$ is generated according to $B1_{max1}$ and $B1_{max2}$ because $B1_{max1}\geq B1_{max2}$ and $B2_{max1}<B2_{max2}$, the red signal of the image signal is transformed according to the red brightness ratio $\beta_3$, and the image is displayed according to the transformed image signal (R', G', B') by using the red sub-pixel, the green sub-pixel, and the second blue sub-pixel. In this example, $\beta_3$ is:

$$\beta_3 = \frac{x11}{x12} = \left(\frac{B1_{max2}}{B1_{max1}}\right)^{\frac{1}{\gamma 1}} = \left(\frac{1191}{1398}\right)^{\frac{1}{2.2}} = 0.929$$

The transformed image signal (R', G', B') is calculated as follows:

$$R'=5\times\beta_1=5\times 0.929=4$$

$$G'=G=10$$

$$B'=B=240$$

In step S220, if $B1_{max1}<B1_{max2}$, $B2_{max1}\geq B2_{max2}$ and the chromaticity coordinate of the image signal is outside a chromaticity range capable of being displayed by the red, green and first blue sub-pixels, a green brightness ratio $\beta_4$ is generated according to $B2_{max1}$ and $B2_{max2}$, the image signal is transformed according to $\beta_4$, and then the image is displayed according to the transformed image signal by using the red, green, and second blue sub-pixels. $\beta_4$ is generated according to the following equation 5:

$$\beta_4 = \frac{x21}{x22} = \left(\frac{B2_{max2}}{B2_{max1}}\right)^{\frac{1}{\gamma 2}}; \quad \text{(equation 5)}$$

In equation 5, x21 is a grayscale of the green sub-pixel when the red, green and first blue sub-pixels are used to generate a second predetermined brightness Bx. x22 is a grayscale of the green sub-pixel when the red, green and second blue sub-pixels are used to generate the second predetermined brightness Bx. $B2_{max1}$ is the first brightness of the green sub-pixel, $B2_{max2}$ is the second brightness of the green sub-pixel and $\gamma 2$ is a gamma value of the green sub-pixel (i.e., $\gamma 2=2.2$). When using the red sub-pixel R, the green sub-pixel G and the first blue sub-pixel B1 to generate the first white image having a chromaticity coordinate (0.28, 0.33) in CIE 1931 color space, the measured first brightness of the red sub-pixel $B1_{max1}$ is 1989 lumen and the measured first brightness of the green sub-pixel $B2_{max1}$ is 1398 lumen. When using the red sub-pixel R, the green sub-pixel G and the second blue sub-pixel B2 to generate the second white image having the same chromaticity coordinate as the first white image, the measured second brightness of the red sub-pixel $B1_{max2}$ is 3055 lumen, and the measured second brightness of the green sub-pixel $B2_{max2}$ is 1191 lumen. If the chromaticity coordinate of the image signal (i.e. R=5、G=10、B=240) is outside a chromaticity range capable of being displayed by the red sub-pixel, the green sub-pixel and the first blue sub-pixel, the green brightness ratio $\beta_4$ is generated according to $B2_{max1}$ and $B2_{max2}$ because $B1_{max1}<B1_{max2}$ and $B2_{max1}\geq B_{max2}$, the green signal of the image signal is transformed according to the green brightness ratio $\beta_4$, and the image is displayed according to the transformed image signal (R', G', B') with the red sub-pixel, the green sub-pixel, and the second blue sub-pixel. In this example, $\beta_4$ is:

$$\beta_4 = \frac{x21}{x22} = \left(\frac{B2_{max2}}{B2_{max1}}\right)^{\frac{1}{\gamma 2}} = \left(\frac{1989}{3055}\right)^{\frac{1}{2.2}} = 0.822$$

The transformed image signal (R', G', B') is calculated as follows:

$$R'=R=5$$

$$G'=10\times\beta_2=200\times 0.822=8$$

$$B'=B=240$$

In step S221, if $B1_{max1} \geq B1_{max2}$, $B2_{max1} \geq B2_{max2}$ and the chromaticity coordinate of the image signal is outside a chromaticity range capable of being displayed by the red, green and first blue sub-pixels, a red brightness ratio $\beta_3$ is generated according to the $B1_{max1}$ and $B1_{max2}$, a green brightness ratio $\beta_4$ is generated according to the $B2_{max1}$ and $B2_{max2}$, the image signal is transformed according to $\beta_3$ and $\beta_4$, and then the image is displayed according to the transformed image signal by using the red, green, and second blue sub-pixels.

For example, when using the red sub-pixel R, the green sub-pixel G and the first blue sub-pixel B1 to generate the first white image having a chromaticity coordinate (0.28, 0.33) in CIE 1931 color space, the measured first brightness of the red sub-pixel $B1_{max1}$ is 1398 lumen, and the measured first brightness of the green sub-pixel $B2_{max1}$ is 3055 lumen. When using the red sub-pixel R, the green sub-pixel G and the second blue sub-pixel B2 to generate the second white image having the same chromaticity coordinate as the first white image, the measured second brightness of the red sub-pixel $B1_{max2}$ is 1191 lumen and the measured second brightness of the green sub-pixel $B2_{max2}$ is 1989 lumen. If the chromaticity coordinate of the image signal (i.e. R=5、G=10、B=240) is outside a chromaticity range capable of being displayed by the red sub-pixel, the green sub-pixel and the first blue sub-pixel, the red brightness ratio $\beta_3$ is generated according to $B1_{max1}$ and $B1_{max2}$, the green brightness ratio $\beta_4$ is generated according to $B2_{max1}$ and $B2_{max2}$ because $B1_{max1} \geq B1_{max2}$ and $B2_{max1} \geq B2_{max2}$, the red signal of the image signal is transformed according to the red brightness ratio $\beta_3$ and the green signal of the image signal is transformed according to the green brightness ratio $\beta_4$. Then the image is displayed according to the transformed image signal (R', G', B') with the red sub-pixel, the green sub-pixel, and the second blue sub-pixel. In this example, $\beta_3$ is:

$$\beta_3 = \frac{x11}{x12} = \left(\frac{B1_{max2}}{B1_{max1}}\right)^{\frac{1}{\gamma 1}} = \left(\frac{1191}{1398}\right)^{\frac{1}{2.2}} = 0.929$$

In this example, $\beta_4$ is:

$$\beta_4 = \frac{x21}{x22} = \left(\frac{B2_{max2}}{B2_{max1}}\right)^{\frac{1}{\gamma 2}} = \left(\frac{1989}{3055}\right)^{\frac{1}{2.2}} = 0.822$$

The transformed image signal (R', G', B') is calculated as follows:

$$R'=5\times\beta_1=5\times 0.929=4$$

$$G'=10\times\beta_2=10\times 0.822=8$$

$$B'=B=240$$

In the present invention, only one of the light blue and dark blue sub-pixels of a pixel is used to generate image data with the red sub-pixel and the green sub-pixel. The dark blue sub-pixel has higher color saturation and the light blue sub-pixel has higher luminous efficiency. If the chromaticity coordinate of the image signal is both within a chromaticity range capable of being displayed by the first sub-pixel, the second sub-pixel and the third sub-pixel and within a chromaticity range capable of being displayed by the first sub-pixel, the second sub-pixel and the fourth sub-pixel, the processed image data is displayed by using the first sub-pixel, the second sub-pixel, and the third sub-pixel. Accordingly, the luminous efficiency of the AMOLED is improved, and the power consumption of the AMOLED display is reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of using a pixel to display an image, the pixel comprising a first sub-pixel, a second sub-pixel, a third sub-pixel and a fourth sub-pixel, the third sub-pixel and the fourth sub-pixel being used to display a substantially same color, the method comprising:

providing a first brightness of the first sub-pixel and a first brightness of the second sub-pixel in a first display mode;

providing a second brightness of the first sub-pixel and a second brightness of the second sub-pixel in a second display mode;

inputting an image signal having a chromaticity coordinate;

generating a first comparison relationship according to the first brightness of the first sub-pixel and the second brightness of the first sub-pixel;

generating a second comparison relationship according to the first brightness of the second sub-pixel and the second brightness of the second sub-pixel;

if the chromaticity coordinate of the image signal is within a chromaticity range capable of being displayed by the first sub-pixel, the second sub-pixel and the third sub-pixel, the first brightness of the first sub-pixel is greater than the second brightness of the first sub-pixel and the first brightness of the second sub-pixel is greater than the second brightness of the second sub-pixel, transmitting the image signal; and displaying the processed image signal in the first display mode, wherein the first display mode is performed by using the first sub-pixel, the second sub-pixel, and the third sub-pixel to display an image, and the second display mode is performed by using the first sub-pixel, the second sub-pixel, and the fourth sub-pixel to display the image.

2. The method of claim 1, wherein:

the step of providing the first brightness of the first sub-pixel and the first brightness of the second sub-pixel in the first display mode comprises:

using the first sub-pixel, the second sub-pixel and the third sub-pixel to display a first white image; and measuring the first brightness of the first sub-pixel and the first brightness of the second sub-pixel when the first white image is displayed; and the step of providing the second brightness of the first sub-pixel and the second brightness of the second sub-pixel in the second display mode comprises:

using the first sub-pixel, the second sub-pixel and a fourth sub-pixel to display a second white image; and measuring the second brightness of the first sub-pixel and the second brightness of the second sub-pixel when the second white image is displayed.

3. The method of claim 1, further comprising:

if the chromaticity coordinate of the image signal is within a chromaticity range capable of being displayed by the first sub-pixel, the second sub-pixel and the third sub-pixel, the first brightness of the first sub-pixel is smaller than the second brightness of the first sub-pixel and the first brightness of the second sub-pixel is greater than the second brightness of the second sub-pixel, transforming the image signal according to a first brightness ratio.

4. The method of claim 3, wherein the first brightness ratio is:

$$\beta_1 = \left(\frac{B1_{max1}}{B1_{max2}}\right)^{\frac{1}{\gamma 1}};$$

wherein $B1_{max\ 1}$ is the first brightness of the first sub-pixel, $B1_{max\ 2}$ is the second brightness of the first sub-pixel, and $\gamma 1$ is a gamma value of the first sub-pixel.

5. The method of claim 1, further comprising:

if the chromaticity coordinate of the image signal is within a chromaticity range capable of being displayed by the first sub-pixel, the second sub-pixel and the third sub-pixel, the first brightness of the first sub-pixel is greater than the second brightness of the first sub-pixel and the first brightness of the second sub-pixel is smaller than the second brightness of the second sub-pixel, transforming the image signal according to a second brightness ratio.

6. The method of claim 5, wherein the second brightness ratio is:

$$\beta_2 = \left(\frac{B2_{max1}}{B2_{max2}}\right)^{\frac{1}{\gamma 2}};$$

wherein $B2_{max\ 1}$ is the first brightness of the second sub-pixel, $B2_{max\ 2}$ is the second brightness of the second sub-pixel, and $\gamma 2$ is a gamma value of the second sub-pixel.

7. The method of claim 1, further comprising:

if the chromaticity coordinate of the image signal is within a chromaticity range capable of being displayed by the first sub-pixel, the second sub-pixel and the third sub-pixel, the first brightness of the first sub-pixel is smaller than the second brightness of the first sub-pixel and the first brightness of the second sub-pixel is smaller than the second brightness of the second sub-pixel, transforming the image signal according to a first brightness ratio and a second brightness ratio.

8. The method of claim 7, wherein the first brightness ratio is:

$$\beta_1 = \left(\frac{B1_{max1}}{B1_{max2}}\right)^{\frac{1}{\gamma 1}};$$

wherein $B1_{max\ 1}$ is the first brightness of the first sub-pixel, $B1_{max\ 2}$ is the second brightness of the first sub-pixel, and $\gamma 1$ is a gamma value of the first sub-pixel; and wherein the second brightness ratio is:

$$\beta_2 = \left(\frac{B2_{max1}}{B2_{max2}}\right)^{\frac{1}{\gamma 2}};$$

wherein $B2_{max\ 1}$ is the first brightness of the second sub-pixel, $B2_{max\ 2}$ is the second brightness of the second sub-pixel, and $\gamma 1$ is a gamma value of the second sub-pixel.

9. The method of claim 1, wherein the third sub-pixel has higher luminous efficiency than the fourth sub-pixel, and the fourth sub-pixel has higher color saturation than the third sub-pixel.

10. A method of using a pixel to display an image, the pixel comprising a first sub-pixel, a second sub-pixel, a third sub-pixel and a fourth sub-pixel, the third sub-pixel and the fourth sub-pixel being used to display a substantially same color, the method comprising:

providing a first brightness of the first sub-pixel and a first brightness of the second sub-pixel in a first display mode;

providing a second brightness of the first sub-pixel and a second brightness of the second sub-pixel in a second display mode;

inputting an image signal having a chromaticity coordinate;

generating a first comparison relationship according to the first brightness of the first sub-pixel and the second brightness of the first sub-pixel;

generating a second comparison relationship according to the first brightness of the second sub-pixel and the second brightness of the second sub-pixel;

if the chromaticity coordinate of the image signal is outside a chromaticity range capable of being displayed by the first sub-pixel, the second sub-pixel and the third sub-pixel, the first brightness of the first sub-pixel is smaller than the second brightness of the first sub-pixel and the first brightness of the second sub-pixel is smaller than the second brightness of the second sub-pixel, transmitting the image signal; and displaying the processed image signal in the second display mode, wherein the second display mode is performed by using the first sub-pixel, the second sub-pixel, and the fourth sub-pixel to display an image, and the first display mode is performed by using the first sub-pixel, the second sub-pixel, and the third sub-pixel to display the image.

11. The method of claim 10, wherein:

the step of providing the first brightness of the first sub-pixel and the first brightness of the second sub-pixel in the first display mode comprises:

using the first sub-pixel, the second sub-pixel and the third sub-pixel to display a first white image; and measuring the first brightness of the first sub-pixel and the first brightness of the second sub-pixel when the first white image is displayed; and the step of providing the second brightness of the first sub-pixel and the second brightness of the second sub-pixel in the second display mode comprises:

using the first sub-pixel, the second sub-pixel and a fourth sub-pixel to display a second white image; and measuring the second brightness of the first sub-pixel and the second brightness of the second sub-pixel when the second white image is displayed.

12. The method of claim 10, further comprising:

if the chromaticity coordinate of the image signal is outside a chromaticity range capable of being displayed by the first sub-pixel, the second sub-pixel and the third sub-pixel, the first brightness of the first sub-pixel is greater than the second brightness of the first sub-pixel and the first brightness of the second sub-pixel is smaller than the second brightness of the second sub-pixel, transforming the image signal according to a first brightness ratio.

13. The method of claim 12, wherein the first brightness ratio is:

$$\beta_1 = \left(\frac{B1_{max2}}{B1_{max1}}\right)^{\frac{1}{\gamma 1}};$$

wherein $B1_{max\ 1}$ is the first brightness of the first sub-pixel, $B1_{max\ 2}$ is the second brightness of the first sub-pixel, and $\gamma 1$ is a gamma value of the first sub-pixel.

14. The method of claim 10, further comprising:

if the chromaticity coordinate of the image signal is outside a chromaticity range capable of being displayed by the first sub-pixel, the second sub-pixel and the third sub-pixel, the first brightness of the first sub-pixel is smaller than the second brightness of the first sub-pixel and the first brightness of the second sub-pixel is greater than the second brightness of the second sub-pixel, transforming the image signal according to a second brightness ratio.

15. The method of claim 14, wherein the second brightness ratio is:

$$\beta_2 = \left(\frac{B2_{max2}}{B2_{max1}}\right)^{\frac{1}{\gamma 2}};$$

wherein $B2_{max\ 1}$ is the first brightness of the second sub-pixel, $B2_{max\ 2}$ is the second brightness of the second sub-pixel, and $\gamma 2$ is a gamma value of the second sub-pixel.

16. The method of claim 10, further comprising:

if the chromaticity coordinate of the image signal is outside a chromaticity range capable of being displayed by the first sub-pixel, the second sub-pixel and the third sub-pixel, the first brightness of the first sub-pixel is greater than the second brightness of the first sub-pixel and the first brightness of the second sub-pixel is greater than the second brightness of the second sub-pixel, transforming the image signal according to a first brightness ratio and a second brightness ratio.

17. The method of claim 16, wherein the first brightness ratio is:

$$\beta_1 = \left(\frac{B1_{max2}}{B1_{max1}}\right)^{\frac{1}{\gamma 1}};$$

wherein $B1_{max\ 1}$ is the first brightness of the first sub-pixel, $B1_{max\ 2}$ is the second brightness of the first sub-pixel, and $\gamma 1$ is a gamma value of the first sub-pixel; and wherein the second brightness ratio is:

$$\beta_2 = \left(\frac{B2_{max2}}{B2_{max1}}\right)^{\frac{1}{\gamma 2}};$$

wherein $B2_{max\ 1}$ is the first brightness of the second sub-pixel, $B2_{max\ 2}$ is the second brightness of the second sub-pixel, and $\gamma 2$ is a gamma value of the second sub-pixel.

18. The method of claim 10, wherein the third sub-pixel has higher luminous efficiency than the fourth sub-pixel, and the fourth sub-pixel has higher color saturation than the third sub-pixel.

* * * * *